United States Patent [19]

Miller

[11] 4,408,789

[45] Oct. 11, 1983

[54] SAFETY LATCH FOR IN SWINGING DOORS

[76] Inventor: Elbrige H. Miller, 1254 S. Florida Ave., Rockledge, Fla. 32955

[21] Appl. No.: 236,810

[22] Filed: Feb. 23, 1981

[51] Int. Cl.[3] ..... E05C 17/16

[52] U.S. Cl. ..... 292/268; 292/68

[58] Field of Search ..... 292/268, 269, 270, 63, 292/67, 69, 68

[56] References Cited

U.S. PATENT DOCUMENTS

| | | | |
|---|---|---|---|
| 189,822 | 4/1877 | Whipple | 292/268 |
| 236,910 | 1/1881 | Phillips | 292/270 |
| 473,785 | 4/1892 | Samuel | 292/268 |
| 1,071,461 | 8/1913 | Poston | 292/63 X |
| 1,336,430 | 4/1920 | Gustafson | 292/63 |
| 1,548,744 | 8/1925 | Pratt | 292/269 |
| 1,722,736 | 7/1929 | Derbyshire | 292/268 |
| 2,442,733 | 6/1948 | Schultz | 292/268 |

FOREIGN PATENT DOCUMENTS

| | | | |
|---|---|---|---|
| 13159 | 9/1903 | Austria | 292/268 |
| 187973 | 2/1937 | Switzerland | 292/268 |
| 511988 | 8/1939 | United Kingdom | 292/268 |

*Primary Examiner*—Richard E. Moore

*Attorney, Agent, or Firm*—Duckworth, Allen, Dyer & Pettis

[57] ABSTRACT

A safety latch is disclosed capable of selectively locking an in swinging door in a closed position, permitting the door to open a predetermined angular displacement, or permitting the door to open freely. The latch includes a bracket with a projecting portion offset from the door, and a pivotable bar capable of limited vertical displacement, and having a slot with a long first portion of predetermined width abruptly expanding to a short second portion of greater width. The projecting portion is capable of selectively engaging the pivotable bar in either the first or second portion of the slot.

4 Claims, 6 Drawing Figures

SAFETY LATCH FOR IN SWINGING DOORS

BACKGROUND OF THE INVENTION

This invention relates generally to safety latches for in swinging doors and, in particular, for a safety latch which is capable of providing the function of locking the door when it is in a closed position, locking the door when it is in a partially open position, and being totally disengaged to permit the free opening of the door.

There are many situations in which a homeowner desires to have a safety latch capable of permitting the door to be opened partially, yet still providing a secure lock in case an intruder attempts a forced entry. One of the more popular of these types of safety latches includes a safety chain having a pin with an enlarged head which engages a slot to provide the locking function. One of the disadvantages with these types of devices is that the chains provided are usually not sufficiently strong to withstand a heavy impact on the door and, therefore, do not provide the desired safety from forced entry by intruders. Numerous other devices have been described which use complex mechanisms to afford the functions desired from a safety latch. These devices include those described in U.S. Pat. No. 2,601,459 (June 24, 1952, Ross); U.S. Pat. No. 2,845,295 (July 29, 1958, Clarke); U.S. Pat. No. 2,368,411 (Jan. 30, 1945, Chambers); and U.S. Pat. No. 3,980,330 (Sept. 14, 1976, Walker). These devices have the disadvantage of either including complex mechanisms for achieving the locking function, or not providing the three functions described from a safety latch. More recently, devices have been described in U.S. Pat. No. 3,940,956 (Mar. 2, 1976, Stevens); and U.S. Pat. No. 3,924,886 (Dec. 9, 1975, Markovitch), which describe substantially complex devices incorporating multiple hinges to provide the three locking functions desired from a safety latch. The multiple hinge design, in addition to incurring additional costs to manufacture, are also rather unattractive and thus are not found in common use in most households. In another more recent patent, U.S. Pat. No. 4,042,265, a relatively simple device is disclosed capable of performing the locking function on a partially open door. The device disclosed has the disadvantage that it cannot perform the locking function on the closed door unless a thumb screw is tightened which is rather inconvenient. In U.S. Pat. No. 4,174,861 (Nov. 20, 1979, Drake), a locking device for use with a dead bolt means is disclosed, which provides three functions desired of a safety latch. The disadvantage with that device is that it requires a conventional dead bolt lock set, to engage the locking device.

SUMMARY OF THE INVENTION

According to the present invention a safety latch for a door is provided capable of selectively locking an in swinging door in a closed position, permitting the door to open a predetermined angular displacement, or permitting the door to open freely. The latch includes a bracket with a projecting portion offset from the door, and a pivotable bar capable of limited vertical displacement, and having a slot with a long portion of predetermined width abruptly expanding to a short portion of greater width. The projecting portion is capable of selectively engaging the slot on the pivotable bar to provide the functions of complete re-locking, providing a locking function for a partially open door, and is also capable of being disengaged so as to provide the free opening of the door.

BRIEF DESCRIPTION OF THE DRAWINGS

Further details are explained below with the help of the examples illustrated in the attached drawings in which.

DESCRIPTION OF THE PREFERRED EMBODIMENT

Figure 1:
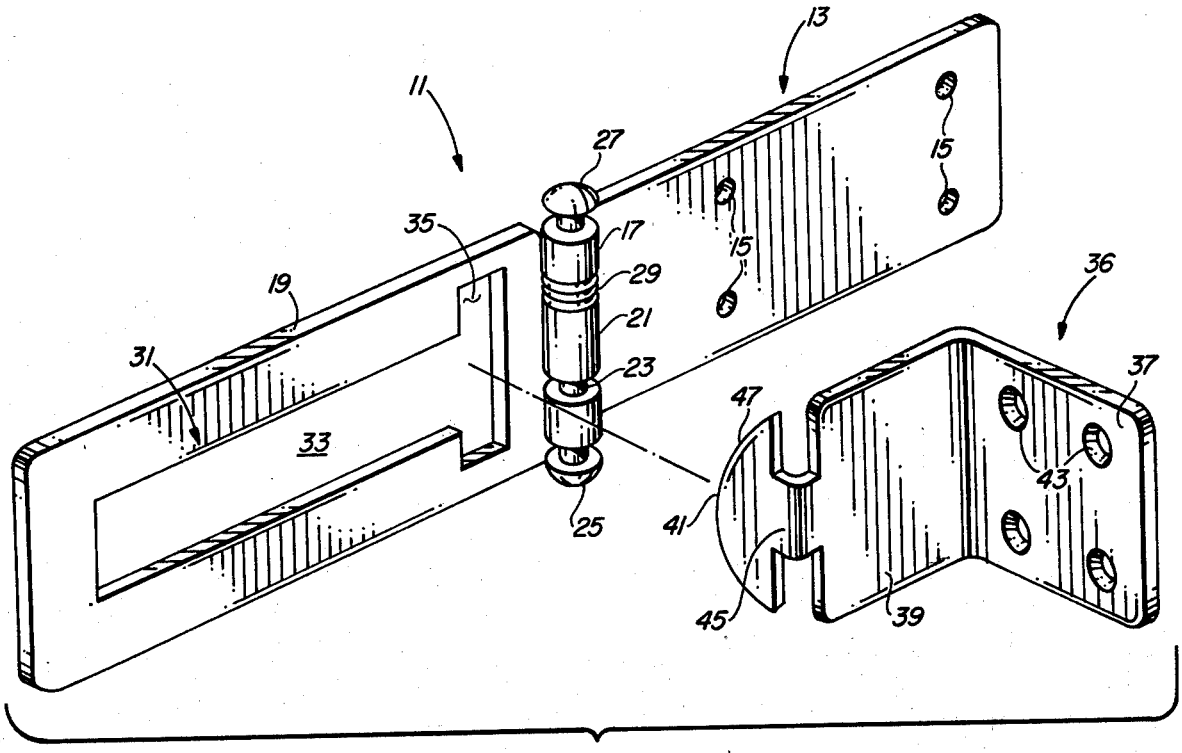
FIG. 1 is an overall view of the safety latch according to the present invention.

As illustrated in FIG. 1, the safety latch of the present invention, generally denoted as 11, includes a jamb plate 13 which is provided with a pluraiity of holes 15 for attachment to a door jamb (not shown) by conventional screws. The screws, if desired, may be of the type that can only be threaded one way as the jamb plate 13 will be exposed when the door is partially opened. The jamb plate 13 includes a hollow cylindrical end portion 17 which forms part of a hinge in the latch 11. The cylindrical portion 17 may be divided in two parts or may form a single piece. The jamb plate 13 is coupled to a pivotable bar 19 which is provided with a cylindrical end portion 21. In the preferred embodiment, the jamb plate is provided with two cylindrical portions 17 spaced apart a predetermined distance. The pivotable bar 19 is provided with a cylindrical end portion 21 which has a width substantially less than the distance between the two cylindrical end portions 17 of the jamb plate 13. This construction allows the pivotable bar 19 to be displaced vertically with respect to the jamb plate 13. The jamb plate 13 and the pivotable bar 19 are coupled at their respective cylindrical end portions 17 and 21 by means of a pin 23. Pin 23 is provided with a large head 25 at the bottom portion, which is sufficiently large to abut into the end of pivotable bar 19. The pin 23 may be provided with a flared top 27 to avoid any possible disconnection from the cylindrical end portions 17 and 21. Alternatively and preferably, the pin 23 may be rigidly secured to cylindrical end position 21 thereby making flared top 27 unnecessary. Cylindrical portion 17 thus forms a bearing surface for pin 23. A helical spring 29 is disposed inbetween the cylindrical end portion 17 and the cylindrical end portion 21 in order to provide a vertical bias on the pivotable bar 19. It is therefore possible to move bar 19 in a vertical position a predetermined distance by exerting pressure on head 25 of pin 23. The spring 29 will normally bias the pivotable bar 19 downwardly.

The pivotable bar 19 is provided with a slot 31 having a first portion 33 of predetermined width which extends longitudinally through pivotable bar 19. Slot 31 also has a second portion 35 which is substantially wider than the width of portion 33.

The safety latch 11 also includes a bracket 36 having a base portion 37, a normal portion 39, and a projecting portion 41. The base portion 37 is provided with a plurality of holes 43 so that the base portion 37 can be secured to a door with conventional screws. The normal portion 39 provides an offset for the projecting portion 41 which serves as the locking mechanism of the latch 11. The projecting portion 41 includes a stem 45 and a head portion 47. The head portion 47 has a substantially smooth contour until the point at which it joins the stem portion 45. That joint is substantially abrupt and in the preferred embodiment constitutes a 90° angle between the top of the stem portion 45 and the side of the head portion 47.

While the sizes of the individual components are not critical, there is a relationship in size between the components which must be maintained in order for the safety latch 11 to be operable. Specifically, the width of the second portion 35 of slot 31 must be larger than the width of the head portion 47 of the bracket 36. Similarly, the width of the first portion 33 of slot 31 must be greater than the width of stem 45. The amount of vertical travel of the pivotable bar 19 depends upon the placement of the bracket 36 on the door. This relationship becomes more apparent upon the description of the function of the safety latch 11 with the aids of the figures below.

Figure 2:
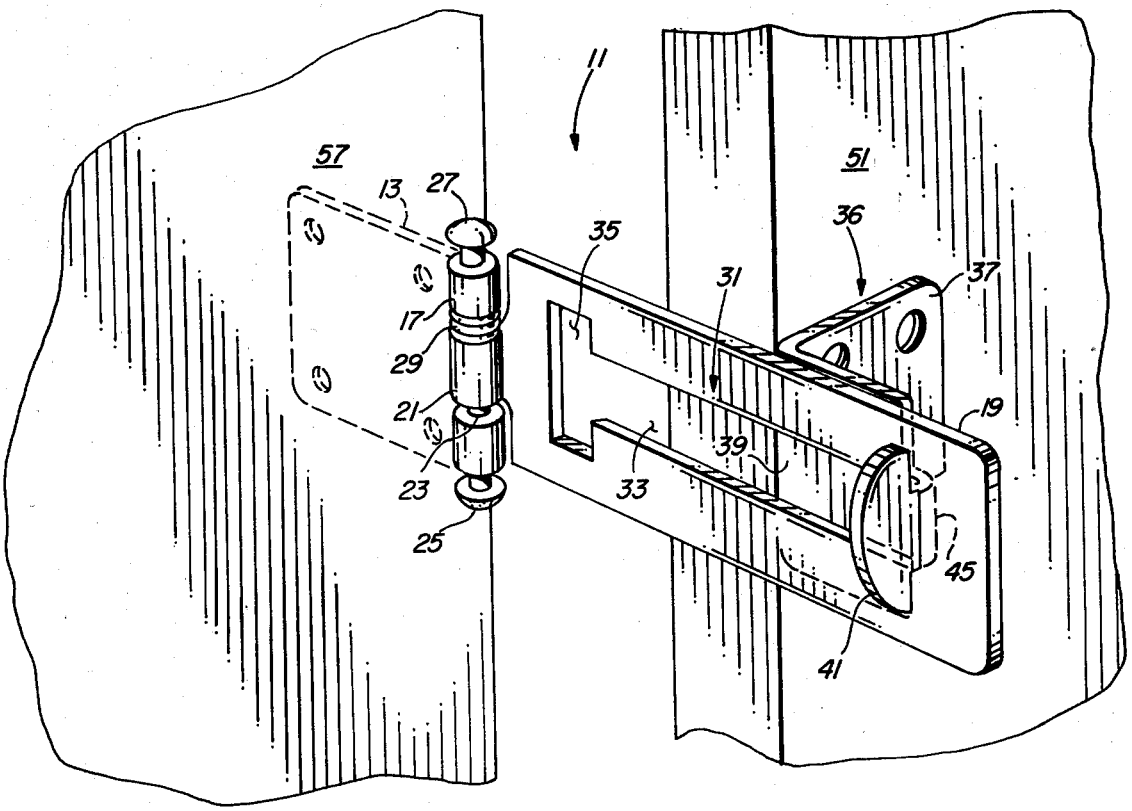
FIG. 2 is a perspective view of the safety latch being engaged with the door in a partially open position.
Figure 5:
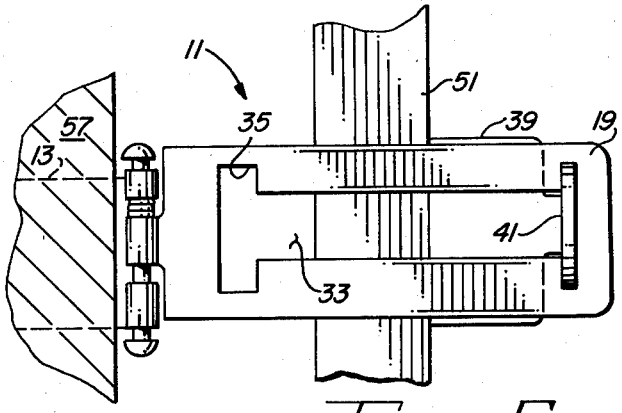
FIG. 5 is a side view of the safety latch being locked with the door in a partially open position.

The locking function with the door partially open is illustrated in FIGS. 2 and 5. In that illustration, it is seen that door 51 is opened the predetermined distance from a jamb 57. At this point the locking function is provided between the interaction of the head 47 and a side wall 59 of the first portion 33 of slot 31. Any force on the door 51 would be resisted by the interaction between the head portion 47 of the bracket 35 and the side wall 59 of pivotable bar 19.

Figure 3:
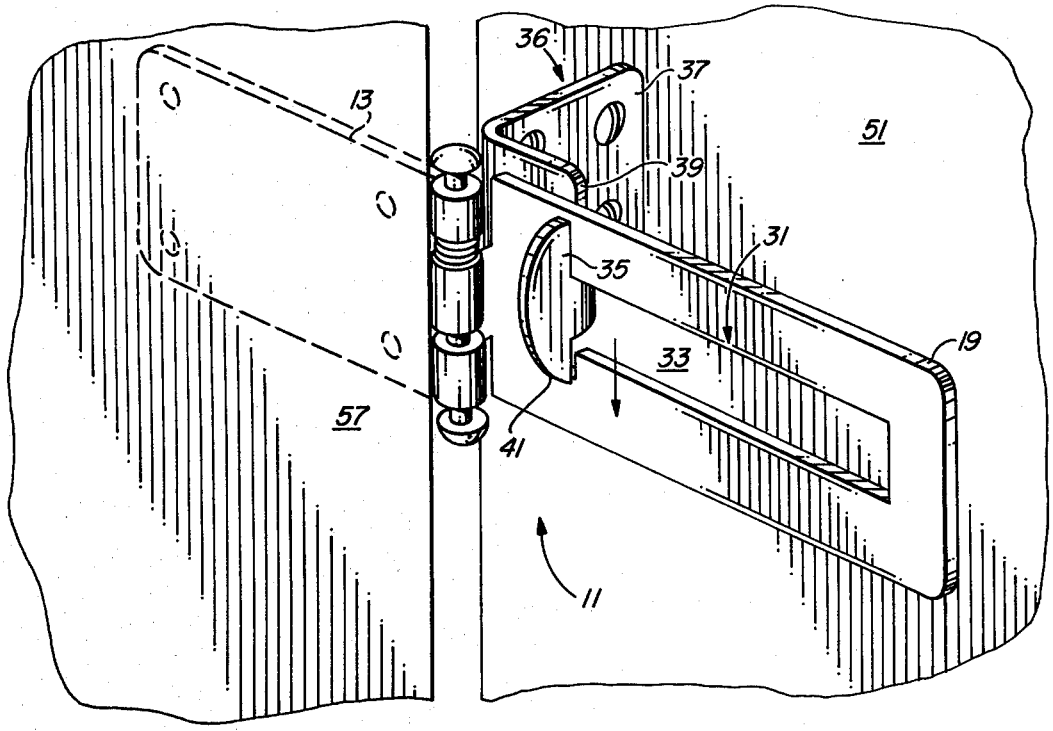
FIG. 3 is a perspective view of the safety latch being locked with the door in the closed position.
Figure 4:
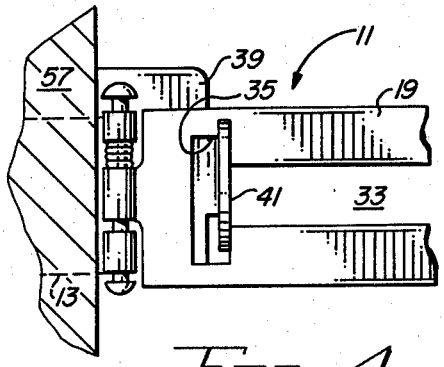
FIG. 4 is a side view with the safety latch being locked with the door in the closed position.

Illustrated in FIGS. 3 and 4 is the safety latch in the locking position when the door 51 is in a substantially closed position. The locking action is provided for the juxtaposition of the stem portion 45 to the corner 53 formed in the upper portion of the second portion 35 of the slot. When an intruder attempts to open the door 51, the stem portion 45 of the bracket 36 is forced against the side wall 55 of the second slotted portion 35 and pivotable bar 19. This situation is made possible by spring 29 which biases pivotable bar 19 downwardly so that the juxtaposition between the stem portion 45 and the side wall portion 55 take place. It should be noted that the placement of bracket 36 on the door must be such that at the normally biased position of pivotable bar 19 the top of the second portion 35 of slot 31 is substantially at the same level as the top portion of stem 45.

Figure 6:
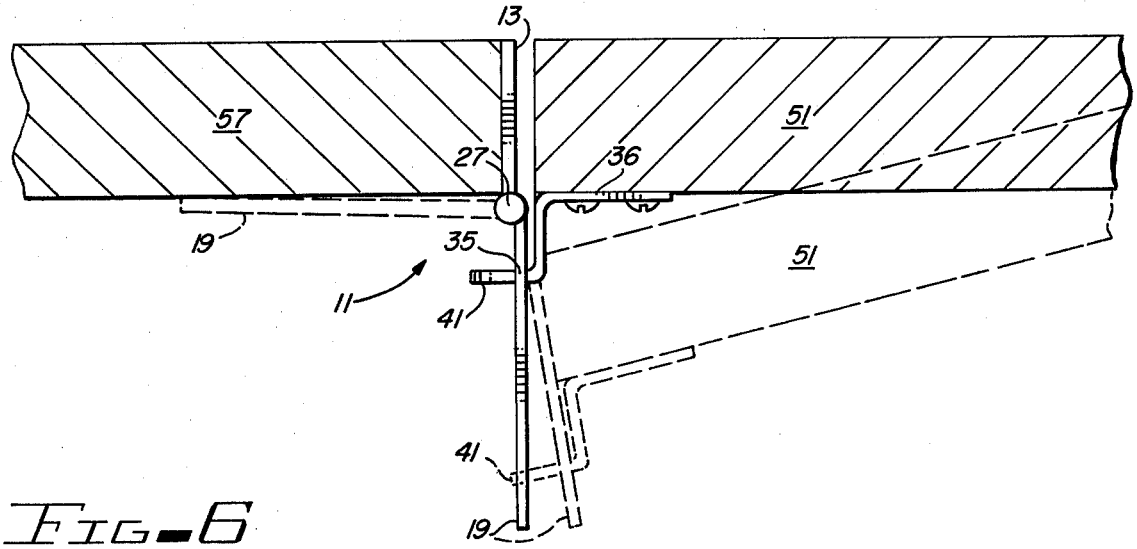
FIG. 6 is a top view of the safety lock.

The versatility of the safety latch 11 is enhanced by the ease of operation, as illustrated in FIG. 6. Under normal conditions, when the door is closed and safety latch 11 is not engaged the pivotable bar 19 would be swung unobstrusively to the side so that it rests substantially flat against the door trim or wall. If the operator desires to lock the door in the closed position he merely pivots bar 19 ninety degrees. As the pivotable bar 19 swings the head 47 of bracket 36 will come into contact with the upper portion of the second portion 35 of slot 33. As the pivotable bar 19 is further rotated, the smooth surface of the head 47 will urge the pivotable bar 19 upwards against the bias force of spring 29. Further, rotation will cause bar 19 to rotate past the head portion 47 and the spring 29 will cause the pivotable bar 19 to drop into a locked position on stem 45.

The present invention provides ease of operation in locking and unlocking for handicapped persons by using the elbow or forearm if necessary. In addition, in cases of panic and/or emergencies, the safety latch, unlike the common safety chain, is easily engaged or disengaged.

It should be understood that although several embodiments of the invention have been described, the invention is susceptible to numerous modifications and embodiments within the ability of those skilled in the art and without the exercise from that faculty. For example, the shape and angular disposition of the individual elements may be changed without changing the manner in which the apparatus performance function. Accordingly, such modifications and embodiments are deemed to be within the spirit, scope and contemplation of this invention.

I claim:

1. A safety latch to be attached to a door and a jamb having an inner face for selectively locking the door in a closed position, permitting the door to open a predetermined angular displacement, or permitting the door to open freely, comprising:

a jamb plate attached to the inner face of the jamb and having a hollow cylindrical end portion protruding from the jamb a predetermined distance;

a pivotable bar having a tubular end portion concentrically juxtaposed to the hollow cylindrical end portion of the jamb plate, the pivotable bar also having a longitudinally disposed T-shaped slot with a first portion of predetermined width and a contiguous second portion of substantially larger width than the first portion said pivotable bar having a barrier defined by the contiguous first and second portions of the slot;

a pin disposed through the hollow cylindrical end portion of the jamb plate and the tubular end portion of the pivotable bar, said pin being a predetermined amount longer than the combined lengths of the hollow cylindrical end portion of the jamb plate and the tubular end portion of the pivotable bar, whereby the pivotable bar can pivot on the pin and can be displaced vertically relative to the jamb plate;

means disposed about the pin for vertically biasing the tubular end portion of the pivotable bar against the cylindrical end portion of the jamb plate; and a bracket having a base portion secured to an edge of the door, a normal portion substantially perpendicular to the base portion, and a projecting portion substantially perpendicular to the normal portion, but disposed in a direction opposite the base portion, said projecting portion having a stem with a width slightly smaller than the width of the first portion of the slot, and a flared portion having a width greater than the width of the stem, but smaller than the width of the second portion of the slot, said flared portion having a substantially smooth contour throughout except at the point where the flared portion joins the stem, at which point there is an abrupt change of contour, whereby as the second portion of the T-shaped slot on the pivotable bar is rotated into contact with the flared portion, the smooth contour acts as a cam surface to raise the pivotable bar against the means for biasing, until the second portion of the T-shaped slot passes the abrupt change of contour where the flared portion meets the stem, and the biasing means forces the pivotable bar downwards against the stem so that the stem portion abuts against the barrier thereby providing a locking function when the door is closed; and whereby as the pivotable bar is displaced vertically, the stem can slide along the first portion of the T-shaped slot as the door is opened.

2. The safety latch of claim 1 wherein said bracket is disposed on the door in relation to the pivotable bar so that the upper portion of the stem is substantially at the same level as the upper part of the second portion of the slot.

3. The safety latch of claim 3 wherein the predetermined length of pin corresponds substantially to the distance between the stem and the flared portion of the bracket at the point where there is an abrupt change of countour.

4. The safety latch of claim 3 wherein said means for vertically biasing comprises a coiled spring disposed around said pin.

* * * * *